US005766746A

United States Patent [19]

Kampl et al.

[11] Patent Number: 5,766,746

[45] Date of Patent: Jun. 16, 1998

[54] FLAME RETARDANT NON-WOVEN TEXTILE ARTICLE

[75] Inventors: Reinhard Kampl; Walter Six, both of Vöcklabruck, Austria; Angela Oberbauer, Morgan Hill, Calif.

[73] Assignee: Lenzing Aktiengesellschaft, Lenzing, Austria

[21] Appl. No.: 553,974

[22] Filed: Nov. 6, 1995

Related U.S. Application Data

[63] Continuation-in-part of Ser. No. 455,146, May 31, 1995, Pat. No. 5,609,950.

[30] Foreign Application Priority Data

Nov. 7, 1994 [AT] Austria ..... 2058/94

[51] Int. Cl.[6] ..... B32B 7/02

[52] U.S. Cl. ..... 428/219; 442/408; 442/414; 442/415; 28/104

[58] Field of Search ..... 428/288, 289, 428/219; 28/103, 104; 442/408, 414, 415

[56] References Cited

U.S. PATENT DOCUMENTS

| | | | |
|---|---|---|---|
| 2,668,096 | 2/1954 | Reeves et al. . | |
| 2,701,244 | 2/1955 | Ham . | |
| 2,983,623 | 5/1961 | Coates . | |
| 3,424,162 | 1/1969 | Parravicini . | |
| 3,636,953 | 1/1972 | Benevento . | |
| 3,648,699 | 3/1972 | Anderson et al. . | |
| 3,906,136 | 9/1975 | Weil . | |
| 3,969,268 | 7/1976 | Fukuda et al. . | |
| 4,040,843 | 8/1977 | Franko-Filipasic et al. . | |
| 4,063,883 | 12/1977 | Hupfl et al. | 8/116 P |
| 4,076,870 | 2/1978 | Yamamoto . | |
| 4,078,101 | 3/1978 | Cole . | |
| 4,105,679 | 8/1978 | Tanabe . | |
| 4,122,552 | 10/1978 | Tedford . | |
| 4,145,463 | 3/1979 | Cole . | |
| 4,172,172 | 10/1979 | Suzuki et al. | 428/224 |
| 4,225,481 | 9/1980 | Wagner . | |
| 4,244,367 | 1/1981 | Rollenhagen . | |
| 4,408,357 | 10/1983 | Toth . | |
| 4,427,408 | 1/1984 | Karami et al. . | |
| 4,452,849 | 6/1984 | Nachbur et al. . | |
| 4,454,189 | 6/1984 | Fukata | 428/224 |
| 4,487,800 | 12/1984 | Nachbur et al. . | |
| 4,494,951 | 1/1985 | Cole et al. . | |
| 4,503,115 | 3/1985 | Hemeis et al. . | |
| 4,597,110 | 7/1986 | Smith, Sr. et al. . | |
| 4,641,381 | 2/1987 | Heran et al. . | |
| 4,646,362 | 3/1987 | Heran et al. . | |
| 4,674,135 | 6/1987 | Greene . | |
| 4,780,359 | 10/1988 | Trask et al. . | |
| 4,930,161 | 6/1990 | Cohen . | |
| 4,938,901 | 7/1990 | Groitzsch et al. | 264/22 |
| 5,051,110 | 9/1991 | Borrell et al. . | |
| 5,103,501 | 4/1992 | Meisels . | |
| 5,114,786 | 5/1992 | Louis . | |
| 5,135,541 | 8/1992 | Cole et al. . | |
| 5,137,600 | 8/1992 | Barnes et al. . | |
| 5,253,397 | 10/1993 | Neveu et al. . | |

FOREIGN PATENT DOCUMENTS

| | | |
|---|---|---|
| 285338 | 10/1988 | European Pat. Off. . |
| 0397947 | 11/1990 | European Pat. Off. . |
| 447605 | 9/1991 | European Pat. Off. . |
| 0560629 | 9/1993 | European Pat. Off. . |
| 2280640 | 2/1976 | France . |
| 1289944 | 2/1969 | Germany . |
| 2532521 | 2/1976 | Germany . |
| 2622569 | 9/1976 | Germany . |
| 93-13249 | 7/1993 | WIPO . |
| 94-26962 | 11/1994 | WIPO . |

*Primary Examiner*—Christopher Raimund
*Attorney, Agent, or Firm*—Baker & Botts, L.L.P.

[57] ABSTRACT

A flame retardant biodegradable non-woven article which is safe and comfortable to wear as apparel can be fabricated from a flame retardant non-woven textile. The flame retardant non-woven textile is prepared by bonding a fleece comprising cellulosic fibers incorporating at least one phosphorous containing flame retardant compound.

30 Claims, 2 Drawing Sheets

FLAME RETARDANT NON-WOVEN TEXTILE ARTICLE

SPECIFICATION

This application is a continuation-in-part of U.S. Ser. No. 08/455,146 filed on May 31, 1995, now U.S. Pat. No. 5,609,950, which is incorporated by reference herein.

BACKGROUND OF THE INVENTION

This invention relates to flame retardant biodegradable non-woven textile articles. The non-woven textile article may be used as disposable apparel, more particularly disposable undergarments and children's disposable apparel including baby bibs which is fabricated from flame retardant non-woven textile. The invention also relates to protective apparel including apparel worn by military personnel, firefighters, race car drivers, flight personnel and the like.

Disposable apparel such as disposable undergarments are worn by the user for a limited time and then discarded. Such disposable undergarments are utilized as underwear for incontinent users, as insulated children's training panties, or for urinal problems, or for usage during menstruation. Disposable garments have also been utilized during travel away from the home and/or for normal daily usage, and for leisure time. Most disposable garments are made of paper or some cellulose material or synthetic materials.

U.S. Pat. No. 5,103,501 to Meisels discloses disposable underwear for use during travelling consisting of three undergarments an undershirt, a pair of men's underpants, and a pair of women's panties. The three undergarments are fabricated of a soft absorbent material. The three undergarments are provided with complex methods of securing the garments, such as magnetic fasteners.

U.S. Pat. No. 4,930,161 to Cohen discloses a medical examination garment with a complex trunk having front and rear portions, a waist region, where an elastic waist-band is located and a crotch. The trunk front-portion includes a rectangular opening intermediate the crotch and waist region. Complex fasteners are used for closure of the front portion.

U.S. Pat. No. 4,674,135 to Greene discloses a disposable undergarment which is formed of a single sheet of non-woven cellulose material such as paper. The material is cut into a complex hourglass shape defining a front portion, two generally complex semicircular opposed cut outs at each side of the material, a detachable crotch insert portion formed within one of the opposed cut outs. The garment includes a detachable circular container portion formed within one of the opposed cut-outs and adjoined to the front forming a pouch to use by the wearer for receiving and storing the undergarment.

U.S. Pat. No. 4,646,362 to Heran et al. discloses a disposable training pant underpart comprising a front panel and a rear panel joined along side seams to provide a three-dimensional garment having a pair of elasticized leg openings and an elasticized waist opening. The training pant further includes a bodyside liner, outer cover and absorbent sandwiched therebetween. The outer cover is made from a two layer composite material which is impervious to liquid and has a clothlike appearance.

U.S. Pat. No. 4,641,381 to Heran et al. also discloses a disposable training pant for children. This garment includes a thick bodyside liner, outer cover, and a thick absorbent therebetween. The outer cover has an inner layer of plastic material and an outer layer of non-woven fibrous material.

U.S. Pat. No. 4,597,110 to Smith et al. discloses a novelty panty-type undergarment having a crotch opening between a complex crotch segment and a front panel. The crotch opening extends parallel to the undergarment waistband and involves first and second fastener means provided to the crotch opening to facilitate selective opening and closing of the crotch by a peeling apart and pressing together the first and second fastener means.

U.S. Pat. No. 4,427,408 to Karami et al. discloses a multilayer disposable diaper comprising an imperious backing sheet, a facing sheet and a pair of absorbent pads placed between the sheets.

U.S. Pat. No. 4,408,357 to Toth discloses a gown having a front panel, a pair of back panels extending from opposed sides of the front panel, and a pair of sleeves. The sleeves are constructed of a water repellant material having nonentangled fibers, and the back panels are constructed of a porous material having entangled fibers or a non-woven material comprising of nonentangled wood pulp and polyester fibers.

U.S. Pat. No. 4,244,367 to Rollenhagen discloses a panty for protecting the garments of wearers who suffer from incontinence, which is comprised of complex stretchable body panels for constriction onto the wearer and including a crotch area over which there is a protective membrane which acts as a liquid repellant throughout the crotch area.

U.S. Pat. No. 4,105,679 to Repke et al. disclose a multilayer disposable undergarment for use in training infants or for use by incontinent adults formed of non-woven stretchable material.

U.S. Pat. No. 4,122,552 to Tedford discloses disposable one-piece undergarments comprising a rectangularly shaped sheet of flexible lightweight material. An adhesive edging joins the material together.

U.S. Pat. No. 3,648,699 to Anderson et al. discloses a disposable garment for incontinent bedridden patients. The garment comprises an outer piece having short leg portions, a waist encircling portion and an inner piece of moisture proof sheet material corresponding to the outline of the outer piece. The inner piece is insertable and removable from the outer piece, and has a layer of moisture absorbent material on one side which contacts the body of the wearer.

U.S. Pat. No. 3,636,953 to Benevento discloses a disposable panty with extra crotch construction in which two supportive layers of the same material as the panty are disposed over the crotch. All fabric portions of the panty are cut as a contiguous blank from a single sheet of fabric material.

U.S. Pat. No. 3,424,162 to Parravicini discloses a disposable hygienic panty comprising of front and rear panels of single layer non-woven cellulose material sewn together to form a waist portion and a body portion with leg openings. A cotton gauze insert may be sewn into the crotch portion, or the panty may be completely lined with gauze.

While a number of disposable garments are described in the prior art, there is a need for disposable garments which are not only easy to manufacture, inexpensive and comfortable to wear but which are also flame retardant and biodegradable. In particular, disposable garments must meet all state government and federal government flammability requirements. These include the Federal Flammability Act Requirements for non-woven fabrics utilized in the fabrication of disposable apparel as set forth in 16 C.F.R. § 1610, State NFPA § 701 and State NFPA § 702 Flammability Act testing.

SUMMARY OF THE INVENTION

It is an object of the invention to provide a flame retardant non-woven apparel article which can be worn while exercising during sports. Preferably such article is biodegradable.

It is also an object of the invention to provide a flame retardant biodegradable non-woven apparel article which is safe and comfortable to wear, and can be manufactured at a low cost. Such articles are particularly suitable for use in institutional settings including medical and penal facilities, as well as in group care facilities such as orphanages, halfway houses, long term facilities and rest homes.

It is a further object of the invention to provide a flame retardant biodegradable non-woven apparel article which is flame retardant, does not irritate the skin and is environmentally safe.

It is also an object of the invention to provide a flame retardant biodegradable non-woven apparel article which provides protection against combustion from accidental fire or overheating during sleeptime usage. This is particularly desirable with respect to flame retardant biodegradable textile articles used as garments for infants and children.

The foregoing need is substantially met by the present invention which provides disposable apparel that can be worn safely and comfortably, and which is inexpensively and easily manufactured using a flame retardant biodegradable non-woven textile in accordance with the invention. The flame retardant non-woven textile is prepared from a fleece comprising cellulosic fibres incorporating at least one phosphorous containing flame retardant compound. Water jets directed onto the fleece in a substantially vertical direction to the fleece entangle the individual fibres of the fleece thereby forming a flame retardant non-woven textile which used to fabricate the disposable garment.

The flame retardant non-woven textile does not require additional binding agents yet displays sufficient tenacity even though exhibiting a low area weight. Moreover the non-woven textile is not too stiff, does not cause any skin irritations, and is for the most part, biodegradable. Surprisingly, it has been found that, in the case of apparel according to the invention, all of these highly desirable requirements can be satisfied while also satisfying government mandated flammability requirements. Particularly striking is that, despite their simple manufacturing technique, the disposable apparel according to the invention are perfectly suited for wearing and non-wearing apparel due to their high flame resistance and tear strength. For example such disposable apparel include but are not limited to apparel such as sun-shirts, sundresses, aprons, hygienic caps, skirts, slips, bras, underwear, bodysuits, blouses, sportswear, industrial jackets (worn by industrial workers), children's clothes for vacation and play usage and children's nightwear. The flame retardant non-woven textile may also be used in protective apparel including, but not limited to, apparel worn by military personnel, firefighters, race car drivers, flight personnel including helicopter personnel, interliners for protective clothing and flame barriers for industrial use, for example, for use in trains, cars and airplanes. The flame retardant non-woven textile may also be used to fabricate non-wearing apparel including, but not limited to, draperies, tablecloths, sheets, pillow cases and the like.

BRIEF DESCRIPTION OF THE DRAWINGS

The invention will be better understood from the following detailed description of the preferred embodiments in conjunction with the accompanying drawings in which.

BRIEF DESCRIPTION OF THE PREFERRED EMBODIMENTS

Figure 1:
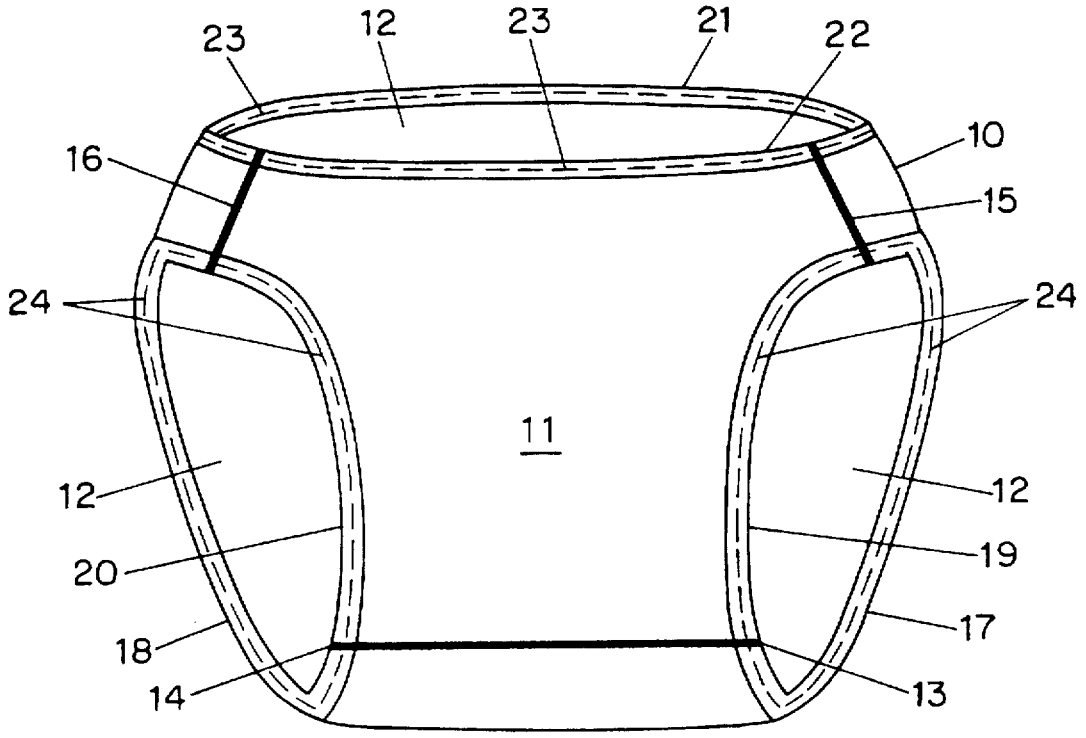
FIG. 1 is a frontal view of a disposable man/boy's brief garment in accordance with the present invention.

These demands are met by a flame retardant non-woven textile article produced by the binder-free bonding of a fleece, characterized in that the fleece contains cellulosic fibres which incorporate at least one-flame retardant compound containing phosphorous.

By the application of cellulosic fibres which incorporate at least one flame retardant compound containing phosphorous, it is meant, in the context of this invention, that the flame retardant characteristic of fibres is not introduced to the fibres when already being processed into fabric or when being bonded to form a non-woven textile, but that this characteristic is already present in the fibre before the bonding procedure, e.g., when laying the fibre. Another important aspect is that the compound containing phosphorous is in fact incorporated in the fibres, and is not simply applied to the fibre surface. Through these measures, it is guaranteed that the compounds will not come off when the product is used or washed out, and can, therefore, not lead to skin irritations or to reduced flame resistance.

Techniques for the incorporation of flame retardant compounds containing phosphorous in cellulosic fibres are known, in particular, from DE-OS 25 32 521 and DE-OS 26 22 569.

As a preference for the formulation of the textile, the fleece is bonded using water jets. It has been shown—quite unexpectedly—that hydro-entanglement, which can be considered an intensive washing process, does not in any way have a negative influence on the flame retardation of the basic fibres. On the contrary, sufficiently flame retardant products emerge also with low area weights.

In a preferred embodiment, the invented textile displays an area weight of 30 to 120 g/m$^2$, and preferably 50 to 80 g/m$^2$. Products with such low area weights are very desirable, with respect to better wear comfort in particular. It is, however, surprising that the invented products completely satisfy all other requirements, particularly with respect to flame retardation, despite their area weight being so low.

In one further preferred embodiment, the fleece which is required for producing the textile according to this invention and the disposable garment itself, substantially consists of the flame retardant cellulosic fibres, i.e., the fleece does not contain any additions worth mentioning, e.g., of other types of fibres.

Often, however, fabrics of blends of different fibre types are desired to meet special requirements so that, in one further preferred embodiment of this invention, the fleece and, therefore, the textile according to this invention, are made of a blend of flame retardant cellulosic fibres in combination with another fibre.

A very advantageous embodiment of the product of this invention consists of a blend of fibres characterized in that the other fibre is a non-melting high-temperature resistant fibre, such as a polyimide or polyaramide fibre. Such high-temperature resistant fibres are known and produce flame retardant fabrics which satisfy very stringent demands when combined with flame retardant cellulosic fibres.

One further advantageous embodiment of the textile in accordance with the invention, is characterized by its compliance with burning classification s-b according to DIN 66

083. This burning classification is the highest category to be obtained by cellulosic fibres and usually suffices for most areas of application for flame retardant textiles. The demands made of textiles in order to comply with burning classification s-b are shown in the next table (Table 1):

TABLE 1

| Burning time (s) | Glowing time (s) | Melting | Dripping | Rate of Decay (mm) |
|---|---|---|---|---|
| ≦2 | ≦25 | No | No | ≦150 |

In addition, the flame retardant textiles and disposable garments fabricated therefrom in accordance with the invention meet all the required State and Federal Flammability Regulations required for non-woven fabrics fabricated into apparel or disposable apparel usage.

As the, or at least as one of the flame retardant compounds containing phosphorous which are incorporated in the cellulosic fibre and are correspondingly contained in the fleece and in the resultant textile, preferably esters, esteramides and/or amides of pyrophosphoric acid, of monothiono-, dithiono-, trithiophosphoric acid, of triphosphoric acid, of monothiono-, dithiono-, trithiono- and/or pentathiotriphosphoric acid are used. Compounds of this kind and their application in cellulosic materials are known from DE-OS 26 22 569 and give the textile structure according to the invention particularly good flame retardant properties.

In a further advantageous manner, the or at least one of the flame retardant compounds containing phosphorous incorporated in the cellulosic fibres and correspondingly in the fleece and in the resultant textile article is/are a Bis-(2-oxo-,1,3,2 dioxaphosphinanyl)-oxide or a Bis-(2-thiono-1,3,2-dioxaphosphinany)-oxide or a 2-oxo-1,3,2-dioxaphosphinanyl-2'thiono-1'3',2' dioxaphosphinanyl-oxide. Compounds of this kind and their use in cellulosic materials are known from DE-OS 25 32 521. Their application in textiles according to this invention leads to textile articles including disposable apparel with excellent flame protection properties.

In a particularly advantageous way, Bis-(5,5-dimethyl-2-thiono-1,3,2-dioxa-phosphinanyl)-oxide is used. This compound is sold under the tradename SANDOFLAM by SANDOZ AG and produces excellent values when used in the textile articles including disposable apparel of the invention.

Preferred embodiments of the invention are described in more detail in the following, whereby it should be pointed out that the examples only represent a small selection of the different possible embodiments of this invention and should not, therefore, restrict the object of this invention in any way.

EXAMPLE 1

Production of a Flame Retardant Non-woven Textile with an Area Weight of 50 g/m$^2$ The starting material for the test was fibres made of 100% Viscose FR. Viscose FR is a flame retardant viscose fibre produced by Lenzing AG with incorporated flame retardant compounds containing phosphorous as described in DE-OS 25 32 521.

The fibre data used for the fibres in the test made of Viscose FR is as follows:

Titre: 1.7 dtex

Cut length: 40 mm

Tenacity cond.: 24 cN/tex

Elongation cond.: 15%

Tenacity wet: 12 cN/tex

Wet Modulus: 3 cN/tex

The fibres display a limited oxygen limit (LOI) of 25%.

The fibres were aerodynamically laid into a random fleece in the usual manner and were finally bonded on a conventional apparatus for hydroentanglement. The fleece was passed through the apparatus three times altogether whereby water jets sprayed in vertical fashion onto the web with different pressures in four different sections (Table 2):

TABLE 2

| Passage No. | Section 1 (MPa) | Section 2 (MPa) | Section 3 (MPa) | Section 4 (MPa) |
|---|---|---|---|---|
| 1 | 0.5 | 4 | 7 | 6 |
| 2 | 4 | 5 | 7 | 4 |
| 3 | 4 | 5 | 7 | 4 |

The resultant non-woven textile structure was dried on a drying stinter at a temperature of 100° C. and a speed of 5 m/min.

In this way, 100 m of textile as described in this invention, was produced with an area weight of approximately 50 g/m$^2$.

EXAMPLE 2

Production of a Flame Retardant Non-woven Textile with an Area Weight of 60 g/m$^2$ With the same starting material and according to process equivalent to Example 1, 100 m of a textile according to the invention were produced with an area weight of approximately 60 g/m$^2$.

The following pressures were recorded when passing through the different sections in the apparatus for hydroentanglement (Table 3):

TABLE 3

| Passage No. | Section 1 (MPa) | Section 2 (MPa) | Section 3 (MPa) | Section 4 (MPa) |
|---|---|---|---|---|
| 1 | 0.5 | 5 | 7 | 9 |
| 2 | 3 | 6 | 8 | 6 |
| 3 | 4.5 | 6 | 8 | 6 |

EXAMPLE 3

Production of a Flame Retardant Non-woven Textile with an Area Weight of 80 g/m$^2$ With the same starting material and according to process equivalent to Example 1, 100 m of a textile according to the invention were produced with an area weight of approximately 80 g/m$^2$.

The following pressures were recorded when passing through the different sections in the apparatus for hydroentanglement (Table 4):

TABLE 4

| Passage No. | Section 1 (MPa) | Section 2 (MPa) | Section 3 (MPa) | Section 4 (MPa) |
|---|---|---|---|---|
| 1 | 0.5 | 6 | 8 | 9 |
| 2 | 3 | 7 | 8 | 6 |
| 3 | 6.5 | 7 | 8 | 6 |

EXAMPLE 4

Properties of the Invented Textile Structure and Comparison Using a Comparative Trial The table which follows (Table 5) lists the properties of the textile articles of the invention produced according to Examples 1–3 and the properties of a non-woven textile produced via a comparative trial.

In this comparative trial, samples were produced according to the conditions of Example 2, however, non flame retardant standard viscose fibres were taken as the starting material.

TABLE 5

| | | Example 1 | Example 2 | Example 2 | Comparative Example |
|---|---|---|---|---|---|
| Area weight | $g/m^2$ | 56.05 | 64.40 | 79.25 | 63.58 |
| Thickness | mm | 0.513 | 0.513 | 0.596 | 0.698 |
| Tear Strength Longitud. | | 55.10 | 70.70 | 82.70 | 70.50 |
| Tear Strength traverse | N | 31.90 | 39.80 | 55.80 | 52.20 |
| Elongation longitud. | % | 31.00 | 30.10 | 32.60 | 30.10 |
| Elongation traverse | | 70.50 | 67.00 | 69.90 | 62.30 |

The tear strength refers to a piece of the respective textile structure with a width of 5 cm.

As can be clearly seen from Table 4, there is no significant loss in tenacity compared to conventional non flame retardant articles in the textiles contained in this invention despite the use of flame retardant substances. This becomes clear, in particular, when comparing the properties of the textile according to Example 2 with those of the sample from the comparative trial, which have about the same area weight.

The burning category of the three textiles of the invention, manufactured according to Examples 1–3 was determined according to DIN 66 083. All three products according to this invention satisfy burning classification s-b of this standard despite their low area weight.

This burning category is only reached by woven textile structures as of an area weight of at least approximately 150 $g/m^2$.

EXAMPLE 5

Disposable Brief

A disposable man/boy's brief garment 10 as shown in FIG. 1 is fabricated from a flame retardant non-woven textile in accordance with the invention as follows. A front cut out portion 11 and back cut out portion 12 are sewn together at the right vertical seam 15 and at the left vertical seam 16 to provide a connected upper body portion forming a back waist edge portion 21 and a front waist edge portion 22. The two vertical side seams 15 and 16 are sewn together by superimposing the side edges and stitching along them using a cotton thread or biodegradable thread.

The crotch seam 13 and 14 is united by superimposing the bottom edges of back and front portions 11 and 12 where they form the crotch seam 13 and 14 and stitching along the crotch seam with cotton or a biodegradable thread.

The edges of the back leg openings 17 and 18, including the side edges of the crotch seam 13 and 14 along with the edges of the front leg openings 19 and 20 are folded over and sewn along the seam 24 with cotton thread or a biodegradable elastic thread.

The top front waist edge 22 and the back waist edge 21 are folded over a thin biodegradable elastic band and then sewn along the fold seam 23 with a cotton thread or biodegradable synthetic thread.

EXAMPLE 6

Disposable Panty

Figure 2:
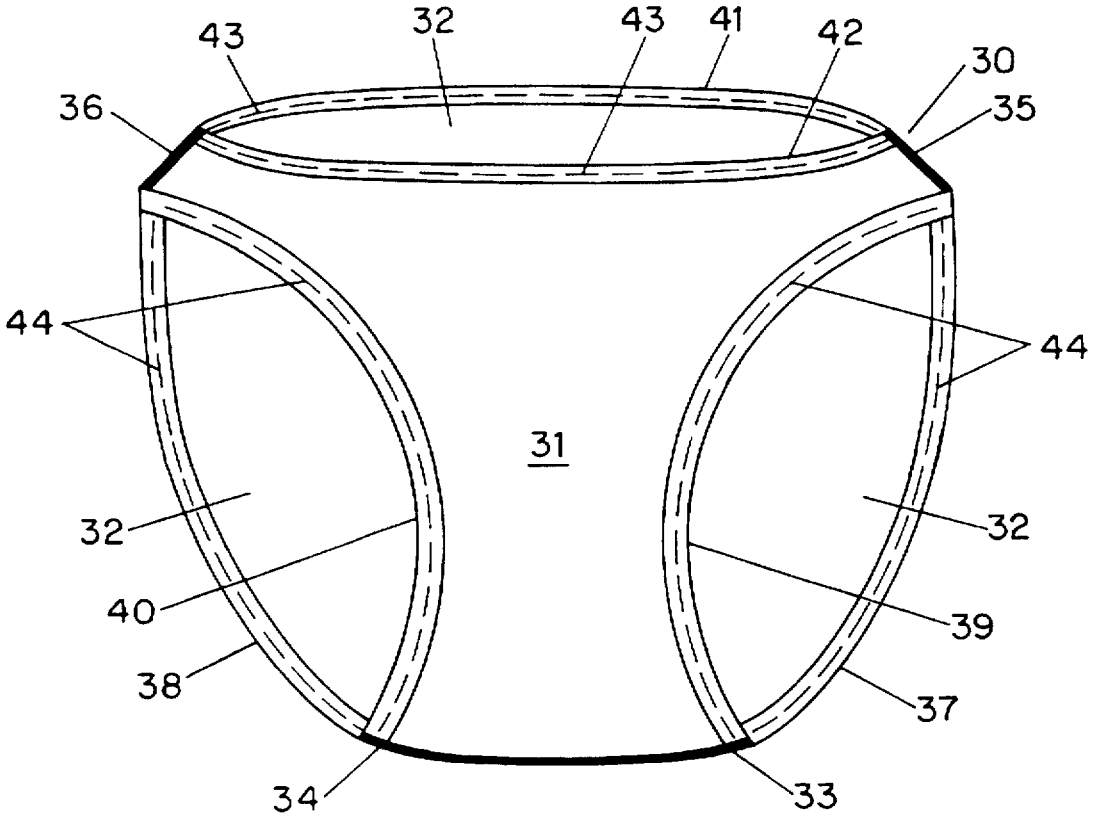
FIG. 2 is a frontal view of a disposable woman/girl's panty garment in accordance with the present invention.

A disposable woman/girl's panty garment 30 as shown in FIG. 2 is fabricated from a flame retardant non-woven textile in accordance with the invention as follows. A front cut out portion 31 and back cut out portion 32 are sewn together at the right vertical seam 35 and at the left vertical seam 36 to provide a connected upper body portion forming a back waist edge portion 41 and a front waist edge portion 42. The two vertical side seams 35 and 36 are sewn together by superimposing the side edges and stitching along them using a cotton thread or biodegradable thread.

The crotch seam 33 and 34 is united by superimposing the bottom edges of back and front portions 31 and 32 where they form the crotch seam 33 and 34 and stitching along the crotch seam with cotton or a biodegradable thread.

The edges of the back leg openings 37 and 38, including the side edges of the crotch seam 33 and 34 along with the edges of the front leg openings 39 and 40 are folded over and sewn along the seam 44 with cotton thread or a biodegradable elastic thread.

The top front waist edge 42 and the back waist edge 41 are folded over a thin biodegradable elastic band and then sewn along the fold seam 43 with a cotton thread or biodegradable synthetic thread.

EXAMPLE 7

Disposable Bib

Figure 3:
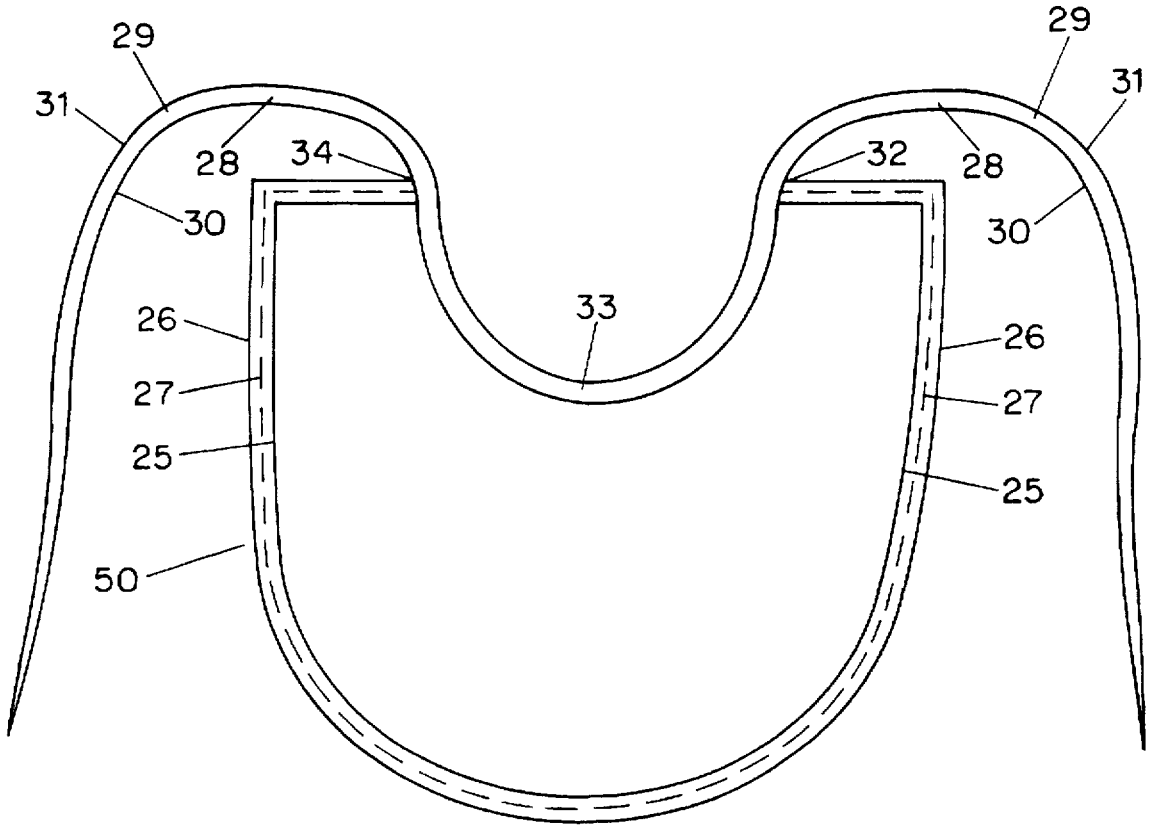
FIG. 3 is a frontal view of a disposable children's bib in accordance with the present invention.

A disposable children's bib garment 50 as shown in FIG. 3 is fabricated from a flame retardant non-woven textile in accordance with the invention as follows. The front cut out portion 25, in the form of a bib, and the back cut out portion 26, in the form of a bib, are sewn together by superimposing the edges of 25 and 26 and stitching the edges along the entire seam 27 of the bib form with double or triple stitching with cotton thread or a biodegradable thread.

In addition, two long narrow strips are cut out of the same flame retardant non-woven textile, a front strip portion 28 and back strip portion 29. The length of these two strips are determined by final desired bib size. The narrow strips are long enough such that once sewn to the bib neck line, which includes right frontal attachment point 32, middle frontal attachment point 33 and left frontal attachment point 34, the narrow strips can extend and be tied comfortably behind the wearer's neck once in use. The two narrow strip portions 28 and 29 are first sewn together along the lower front seam 30 and upper seam 31 with cotton thread or biodegradable thread. The joined strips are sewn onto the neck portion of the bib form at attachment point 32 and at middle frontal attachment point 33, and at left frontal attachment point 34 with double or triple stitching, using cotton thread or biodegradable thread.

While the invention has been described in terms of the foregoing specific embodiments thereof, it will be apparent to those skilled in the art that various alterations and modifications may be made to the described embodiments without departing from the scope of the invention, as defined by the appended claims. For example, biodegradable dyes may used in the flame retardant textile articles of the invention.

We claim:

1. Flame retardant article comprising a flame retardant biodegradable non-woven textile prepared by the process of bonding by hydroentanglement a fleece comprising cellulosic fibres incorporating at least one phosphorous containing flame retardant compound, the area weight of said textile being 30 to 120 g/m$^2$.

2. Flame retardant article according to claim 1, wherein the area weight of the textile is 50 to 80 g/m$^2$.

3. Flame retardant article according to claims 1 or 2, wherein the fleece comprises a blend of cellulosic fibres and at least one other fibre.

4. Flame retardant article according to claim 3, wherein the other fibre is a non-melting fibre.

5. Flame retardant article according to claim 4, wherein the other fibre is selected from the group consisting of polyimide and polyaramide.

6. Flame retardant article according to claims 1 or 2, wherein the phosphorous containing flame retardant compound is selected from the group consisting of phosphoric ester, esteramide of phosphoric acid, amide of phosphoric acid, ester of pyrophosphoric acid, esteramide of pyrophosphoric acid, amide of pyrophosphoric acid, ester of monothionophosphoric acid, esteramide of monothionophosphoric acid, amide of monothionophosphoric acid, ester of dithionophosphoric acid, esteramide of dithionophosphoric acid, amide of dithionophosphoric acid, ester of trithiophosphoric acid, esteramide of trithiophosphoric acid, amide of trithiophosphoric acid, ester of triphosphoric acid, esteramide of triphosphoric acid, amide of triphosphoric acid, ester of monothionotriphosphoric acid, esteramide of monothionotriphosphoric acid, amide of monothionotriphosphoric acid, ester of dithionotriphosphoric acid, esteramide of dithionotriphosphoric acid, amide of dithionotriphosphoric acid, ester of trithionotriphosphoric acid, esteramide of trithionotriphosphoric acid, amide of trithionotriphosphoric acid, ester of pentathiotriphosphoric acid, esteramide of pentathiotriphosphoric acid, amide of pentathiotriphosphoric acid, and combinations thereof.

7. Flame retardant article according to claims 1 or 2, wherein the phosphorous containing flame retardant compound is selected from the group consisting of a Bis (2-oxo-1,3,2-dioxaphosphinanyl)-oxide, a Bis (2-thiono-1,3,2-dioxaphosphinanyl)-oxide, and a 2-oxo-1,3,2-dioxaphosphinanyl-2'-thiono-1',3',2'-dioxaphosphinanyl-oxide.

8. Flame retardant article according to claim 7, wherein the phosphorous containing flame retardant is Bis (5,5 dimethyl-2-thiono-1,3,2 dioxa-phosphinanyl)-oxide.

9. Flame retardant article according to claims 1 or 2, wherein the non-woven textile exhibits the properties required for an s-b burning classification according to DIN 66 083.

10. Flame retardant article according to claim 9, wherein said article comprises wearing apparel.

11. Flame retardant article according to claim 9, wherein said article comprises non-wearing apparel.

12. Flame retardant article according to claim 10, wherein the wearing apparel is selected from the group consisting of underwear, children's bibs, hygienic caps, aprons, bras, bodysuits, industrial jackets, sportswear and children's nightwear.

13. Flame retardant article according to claim 10, wherein the wearing apparel is selected from the group consisting of apparel worn by military personnel, firefighters, race car drivers and flight personnel.

14. Flame retardant article according to claim 11, wherein the non-wearing apparel is selected from the group consisting of draperies, tablecloths, sheets and pillow cases.

15. Flame retardant article according to claim 9, wherein said article is selected from the group consisting of interliners for protective clothing and flame barriers for industrial use.

16. A method of preparing a flame retardant article comprising the steps of:

providing a fleece comprising cellulosic fibres incorporating at least one phosphorous containing flame retardant compound;

directing water jets onto the fleece in a substantially vertical direction to the fleece;

entangling the individual fibres of the fleece thereby forming a flame retardant non-woven textile, the area weight of said textile being 30 to 120 g/cm$^2$; and fabricating a biodegradable article from the non-woven textile.

17. A method of preparing a flame retardant article according to claim 16, wherein the area weight of the textile is 50 to 80 g/m$^2$.

18. A method of preparing a flame retardant article according to claims 16 or 17, wherein the fleece comprises a blend of cellulosic fibres and at least one other fibre.

19. A method of preparing a flame retardant article according to claim 18, wherein the other fibre is a non-melting fibre.

20. A method of preparing a flame retardant article according to claim 19, wherein the other fibre is selected from the group consisting of polyimide and polyaramide.

21. A method of preparing a flame retardant article according to claims 16 or 17, wherein the phosphorous containing flame retardant compound is selected from the group consisting of phosphoric ester, esteramide of phosphoric acid, amide of phosphoric acid, ester of pyrophosphoric acid, esteramide of pyrophosphoric acid, amide of pyrophosphoric acid, ester of monothionophosphoric acid, esteramide of monothionophosphoric acid, amide of monothionophosphoric acid, ester of dithionophosphoric acid, esteramide of dithionophosphoric acid, amide of dithionophosphoric acid, ester of trithiophosphoric acid, esteramide of trithiophosphoric acid, amide of trithiophosphoric acid, ester of triphosphoric acid, esteramide of triphosphoric acid, amide of triphosphoric acid, ester of monothionotriphosphoric acid, esteramide of monothionotriphosphoric acid, amide of monothionotriphosphoric acid, ester of dithionotriphosphoric acid, esteramide of dithionotriphosphoric acid, amide of dithionotriphosphoric acid, ester of trithionotriphosphoric acid, esteramide of trithionotriphosphoric acid, amide of trithionotriphosphoric acid, ester of pentathiotriphosphoric acid, esteramide of pentathiotriphosphoric acid, amide of pentathiotriphosphoric acid, and combinations thereof.

22. A method of preparing a flame retardant article according to claims 16 or 17, wherein the phosphorous containing flame retardant compound is selected from the group consisting of a Bis (2-oxo-1,3,2-dioxaphosphinanyl)-oxide, a Bis (2-thiono-1,3,2-dioxaphosphinanyl)-oxide, and a 2-oxo-1,3,2-dioxaphosphinanyl-2'-thiono-1',3',2'-dioxaphosphinanyl-oxide.

23. A method of preparing a flame retardant article according to claim 22, wherein the phosphorous containing flame retardant is Bis (5,5 dimethyl-2-thiono-1,3,2 dioxaphosphinanyl)-oxide.

24. A method of preparing a flame retardant article according to claims 16 or 17, wherein the non-woven textile exhibits the properties required for an s-b burning classification according to DIN 66 083.

25. A method of preparing a flame retardant article according to claim 24, wherein said article comprises wearing apparel.

26. A method of preparing a flame retardant article according to claim 24, wherein said article comprises non-wearing apparel.

27. A method of preparing a flame retardant article according to claim 25, wherein the wearing apparel is selected from the group consisting of underwear, children's bibs, hygienic caps, aprons, bras, bodysuits, industrial jackets, sportswear and children's nightwear.

28. A method of preparing a flame retardant article according to claim 25, wherein the wearing apparel is selected from the group consisting of apparel worn by military personnel, firefighters, race car drivers and flight personnel.

29. A method of preparing a flame retardant article according to claim 24, wherein said article is selected from the group consisting of interliners for protective clothing and flame barriers for industrial use.

30. A method of preparing a flame retardant article according to claim 26, wherein the non-wearing apparel is selected from the group consisting of draperies, tablecloths, sheets and pillow cases.

* * * * *

UNITED STATES PATENT AND TRADEMARK OFFICE

CERTIFICATE OF CORRECTION

PATENT NO. : 5,766,746

DATED : June 16, 1998

INVENTOR(S) : Kampl et al.

It is certified that error appears in the above-identified patent and that said Letters Patent is hereby corrected as shown below:

Col. 2, line 25, "disclose" should read --discloses--;

Col. 3, line 29, "which used" should read --which is used--; and

Col. 7, line 11, second occurrence, "Example 2" should read --Example 3--.

Signed and Sealed this

Sixteenth Day of November, 1999

*Attest:*

Q. TODD DICKINSON

*Attesting Officer*

*Acting Commissioner of Patents and Trademarks*